US007777689B2

(12) United States Patent
Fratti et al.

(10) Patent No.: US 7,777,689 B2
(45) Date of Patent: Aug. 17, 2010

(54) USB DEVICE, AN ATTACHED PROTECTIVE COVER THEREFORE INCLUDING AN ANTENNA AND A METHOD OF WIRELESSLY TRANSMITTING DATA

(75) Inventors: Roger A. Fratti, Mohnton, PA (US); Yihjye Twu, Scotch Plains, NJ (US)

(73) Assignee: Agere Systems Inc., Allentown, PA (US)

( * ) Notice: Subject to any disclaimer, the term of this patent is extended or adjusted under 35 U.S.C. 154(b) by 923 days.

(21) Appl. No.: 11/567,486

(22) Filed: Dec. 6, 2006

(65) Prior Publication Data

US 2008/0136737 A1 Jun. 12, 2008

(51) Int. Cl.
*H01Q 1/36* (2006.01)

(52) U.S. Cl. ..... 343/895; 343/702; 343/906; 455/575.7

(58) Field of Classification Search ..... 343/702, 343/895, 906; 361/737; 455/575.7
See application file for complete search history.

(56) References Cited

U.S. PATENT DOCUMENTS

| | | | | |
|---|---|---|---|---|
| 4,356,492 | A | 10/1982 | Kaloi | |
| 5,420,599 | A | 5/1995 | Erkocevic | |
| 5,859,614 | A | 1/1999 | Paolella et al. | |
| 6,100,848 | A | 8/2000 | Hayes | |
| 6,377,227 | B1 | 4/2002 | Zhu et al. | |
| 6,408,190 | B1 | 6/2002 | Ying | |
| 6,424,317 | B2 | 7/2002 | Rudish | |
| 6,515,629 | B1 | 2/2003 | Kuo et al. | |
| 6,529,168 | B2 | 3/2003 | Mikkola et al. | |
| 6,535,170 | B2 | 3/2003 | Sawamura et al. | |
| 6,567,048 | B2 | 5/2003 | McKinzie et al. | |
| 6,611,235 | B2 | 8/2003 | Barna et al. | |
| 6,614,400 | B2 | 9/2003 | Egorov | |
| 6,734,825 | B1 | 5/2004 | Guo et al. | |
| 6,759,984 | B2 | 7/2004 | Wielsma | |
| 6,795,028 | B2 | 9/2004 | Stutzman et al. | |
| 6,922,172 | B2 | 7/2005 | Oshiyama et al. | |
| 7,057,560 | B2 | 6/2006 | Erkocevic | |
| 7,231,236 | B2 * | 6/2007 | Cho | 455/575.7 |
| 2002/0004125 | A1 | 1/2002 | Ostrovsky | |
| 2002/0175866 | A1 | 11/2002 | Gram | |
| 2003/0001787 | A1 | 1/2003 | Clifton | |
| 2003/0207668 | A1 | 11/2003 | McFarland et al. | |
| 2004/0027288 | A1 | 2/2004 | Okubora et al. | |
| 2004/0198293 | A1 | 10/2004 | Sadler et al. | |
| 2004/0212545 | A1 | 10/2004 | Li et al. | |
| 2006/0131431 | A1 * | 6/2006 | Finn | 235/492 |

FOREIGN PATENT DOCUMENTS

| | | | |
|---|---|---|---|
| EP | 0 986 130 | A2 | 9/1999 |
| EP | 1 263 083 | A2 | 12/2002 |
| JP | 2006067254 | A * | 3/2006 |

* cited by examiner

*Primary Examiner*—Tan Ho

(57) ABSTRACT

An attached protective cover of a USB device, a USB device and a method of wirelessly transmitting data. In one embodiment, the attached protective cover of a USB device includes a cap with an associated antenna and is configured to protect a USB plug of the USB device. Additionally, the cap includes a link configured to provide a physical connection between the cap and a body of the USB device and an electrical connection between the antenna and a wireless connection system included within the body.

28 Claims, 2 Drawing Sheets

USB DEVICE, AN ATTACHED PROTECTIVE COVER THEREFORE INCLUDING AN ANTENNA AND A METHOD OF WIRELESSLY TRANSMITTING DATA

TECHNICAL FIELD OF THE INVENTION

The present invention is directed, in general, to antennas for wirelessly communicating data and, more particularly, to an attached protective cover of a USB device having an antenna and a method of operation thereof.

BACKGROUND OF THE INVENTION

Portable electronic devices allow users to be mobile. Instead of being fixed to a single location, a person can use a portable electronic device to work or play at multiple locations. For example, a user can download information from a fixed location to a laptop and use the laptop at other locations.

In addition to allowing mobility, users of the portable electronic devices also desire connectivity. As such, wireless connectivity is one of the fastest growing technologies over the last few years. A Wireless Local Area Network (WLAN), based on the Institute of Electrical and Electronic Engineers (IEEE) 802.11b standard and commonly known as "Wi-Fi," is an example of one network that promotes wireless connectivity. The 802.11b standard uses frequencies between 2.4 GHz and 2.5 GHz of the electromagnetic spectrum (the "2 GHz band") and allows users to transfer data at speeds up to 11 Mbit/sec.

IEEE standard 802.11a extends the 802.11b standard to frequencies between 5.2 GHz and 5.8 GHz (the "5 GHz band") and allows data to be exchanged at even faster rates (up to 54 Mbit/sec), but at a shorter operating range than does 802.11b. IEEE 802.11g is an additional standard that uses the 2 GHz band as in 802.11b, but broadens the data rates to 54 Mbps by using orthogonal frequency division multiplexing (OFDM) technology.

802.16 is an example of another IEEE standard for wireless transmission of data. Commonly known as "WiMAX," the IEEE standard uses various frequencies including 2.3-2.5 GHz and 3.4-3.5 GHz ranges of the electromagnetic spectrum and allows users to transfer data at speeds up to 70 Mbit/sec. Ultra-Wideband (UWB) is yet another wireless technology for transmitting data. An UWB system transmits data spread over a large bandwidth of 3.1-10.6 GHz at data rates including 53.3 Mb/s, 106.7 Mb/s and 200 Mb/s. Other standards also exist to govern wireless communications.

Portable electronic devices, such as laptops, personal digital assistants, mobile telephones, gaming devices, etc., are often manufactured with the capability for wireless communication (i.e., wireless transmission and wireless reception of data) according to standards such as those discussed above. Fixed electronic devices, such as desktop PCs, routers, printers, game stations, etc., may also have wireless capability installed during manufacturing.

If an electronic device does not have wireless capability, then an accessory may be used to allow the device to communicate wirelessly. An appropriately configured Universal Serial Bus (USB) device is such an accessory. USB devices are compatible with USB plugs and are well known in the art. USB devices may be known under other names, such as, pen drives. A USB flash device is an example of a USB device that employs flash memory.

A USB device can include the appropriate hardware, sequence of operating instructions or combination thereof to provide wireless connectivity for an electronic device. In other words, a USB device can be configured to wirelessly transmit and receive data. The USB device can be connected to an electronic device, fixed or portable, through a USB plug to enable the electronic device for wireless communication according to various standards such as those mentioned above.

The USB devices that provide wireless connectivity include an antenna. Recently, some USB devices have an antenna fabricated on an interior board surface located in the USB device. Due to the small physical size of USB devices, however, circuitry within the USB device can cause interference with the antenna and impact the propagation and reception of radio frequency signals.

Accordingly, what is needed in the art is a USB device that enables wireless connectivity and reduces antenna interference.

SUMMARY OF THE INVENTION

To address the above-discussed deficiencies of the prior art, the present invention provides, in one aspect, an attached protective cover of a USB device. In one embodiment, the attached protective cover includes: (1) a cap including an antenna associated therewith and configured to protect a USB plug of a USB device and (2) a link configured to provide a physical connection between the cap and a body of the USB device and an electrical connection between the antenna and a wireless connection system included within the body.

In another aspect, the invention provides a USB device. In one embodiment, the USB device includes: (1) a body having a memory including a wireless connection system, (2) a USB port coupled to the memory and including a USB plug and (3) an attached protective cover removably couplable from the USB plug. The attached protective cover includes: (3A) a cap including an antenna associated therewith and configured to protect the USB plug and (3B) a link configured to provide a physical connection between the cap and the body and an electrical connection between the antenna and the wireless connection system.

In yet another aspect, the present invention provides a method of wirelessly transmitting data. In one embodiment, the method includes: (1) receiving data to be transmitted in a wireless connection system associated with a USB device connected to an other device, (2) processing the data for wireless transmission employing the wireless connection system and (3) transmitting the processed data via an antenna associated with an attached protective cover of the USB device.

The foregoing has outlined preferred and alternative features of the present invention so that those skilled in the pertinent art may better understand the detailed description of the invention that follows. Additional features of the invention will be described hereinafter that form the subject of the claims of the invention. Those skilled in the pertinent art should appreciate that they can readily use the disclosed conception and specific embodiment as a basis for designing or modifying other structures for carrying out the same purposes of the present invention. Those skilled in the pertinent art should also realize that such equivalent constructions do not depart from the spirit and scope of the invention.

BRIEF DESCRIPTION OF THE DRAWINGS

For a more complete understanding of the invention, reference is now made to the following descriptions taken in conjunction with the accompanying drawing, in which.

DETAILED DESCRIPTION

Before describing the technical aspects of various embodiments of the present invention, its use and possible advantages should be understood in nontechnical, colloquial terms. With a USB device as described herein, a user can, for example, connect the USB device to a laptop without wireless connectivity to provide wireless communication for the laptop. Unlike conventional USB devices that provide wireless connectivity, at least a portion of the antenna for the wireless communication in the present invention is integrated with a cap of the USB device. The cap is continually connected to a body of the USB device via a link that also provides an electrical path between the antenna and a wireless connection system associated with the USB device. The electrical path may be, for example, a feedline for the antenna or even a radiating element for the antenna. The link may be constructed of a high tensile material such that the cap can be positioned away from the body when removed from a USB plug of the USB device and that position maintained.

Thus, the present invention allows a user to remove the cap off the USB plug and, because of the link, create an air interface between the antenna and the body when wirelessly communicating. The removal and repositioning of the cap places the antenna in a better physical position for transmission and reception of signals. The air interface reduces interference to the antenna caused by the dielectric material of the body and the circuitry within the body or laptop.

Figure 1:
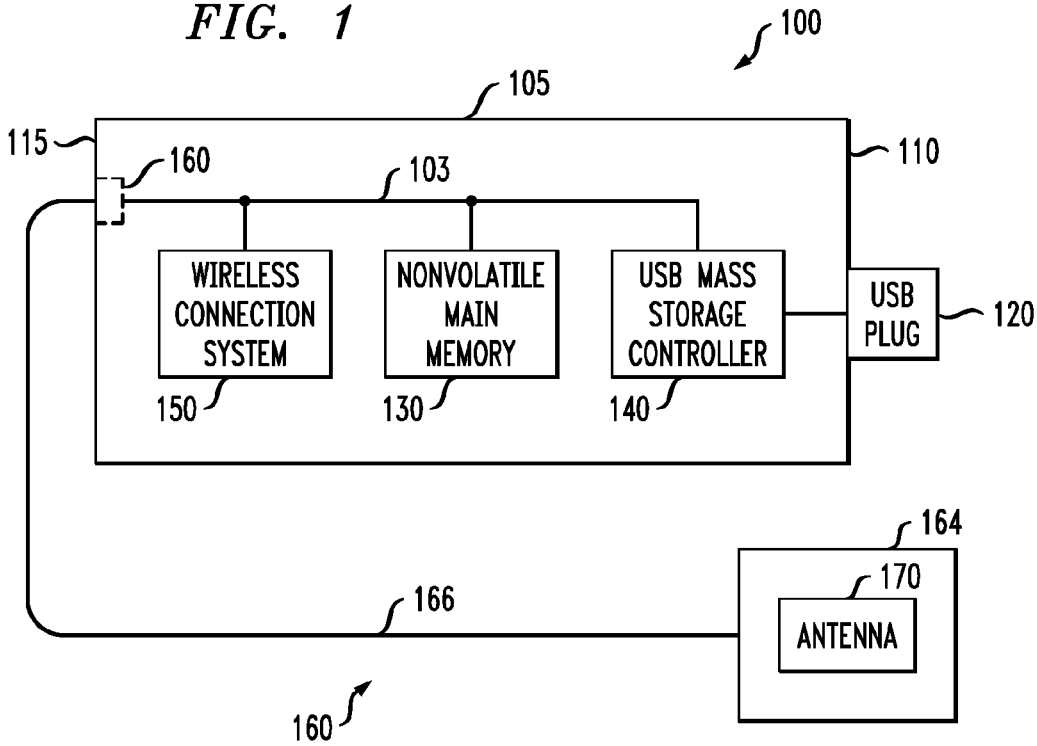
FIG. 1 illustrates an embodiment of a block diagram of a USB device constructed according to the principles of the present invention.

Turning now to FIG. 1, illustrated is a block diagram of an embodiment of a USB device, generally designated 100, constructed according to the principles of the present invention. The USB device 100 contains some components that are found in conventional USB devices including a bus 103, a body 105, a USB plug 120, a non-volatile main memory 130 and a USB mass storage controller 140. One skilled in the art will understand that the USB device 100 may include additional components typically included in a conventional USB device that are not illustrated or discussed.

The USB device 100 is configured to connect to an electronic device via the USB plug 120. The USB device 100 may be a USB 2.0 device. Of course, the USB device 100 may be compatible with another or multiple USB versions.

The body 105, typically formed of plastic, is tough, rigid and serves to support the various components contained within it including the nonvolatile main memory 130 and the USB mass storage controller 140. The body 105 may be constructed according to a body of a conventional USB device. The body 100 has a first end 110 and a second end 115 opposite the first end, as shown. The USB plug 120 extends from the first end. The USB plug may be a Type A USB plug, but can be of any other type. The USB plug 120 is configured to connect the USB device 100 to electronic devices with USB ports, such as laptops, personal digital assistants, mobile telephones, gaming devices, etc. One skilled in the art will understand the configuration and operation of the USB plug 120.

The nonvolatile main memory 130, which in the illustrated embodiment is a flash memory, is contained within the body 105. As such the USB device 100 may be considered a USB flash device. The nonvolatile main memory 130 is configured to provide storage for user files, which may take the form of files, folders (also called "subdirectories") or other data of interest to a user. (The nonvolatile main memory 130 may also provide storage for non-user files, such as system files and directory and formatting data.) The nonvolatile main memory 130 is advantageously of large capacity, typically greater than 100 megabytes (MB), but may be one gigabyte (GB) or larger. In other embodiments, the USB device 100 may include another type of memory, such as, a micro-sized hard disk drive. In such embodiments, the USB device 100 could be considered a USB hard drive. Additionally, instead of a flash memory, another type of solid state memory device may be used.

The USB mass storage controller 140 is coupled to the nonvolatile main memory 130 and the USB plug 120 via the bus 103. Together, the USB mass storage controller 140 and the USB plug 120 are regarded as a USB port. As those skilled in the pertinent art will understand, the USB mass storage controller 140 is configured to communicate through the USB plug 120 to establish a logical connection with a hosting device (not shown in FIG. 1), such as the electronic devices discussed above. During the establishment of that logical connection, the USB mass storage controller 140 communicates information regarding the USB device 100 such that the hosting device may understand its storage and file transfer capabilities and functions, such as, wireless communications.

The USB device 100 also includes a wireless connection system 150 that is also coupled to the bus 103. The wireless connection system 150 is configured to process data for wireless transmission or process data received via wireless transmission. The wireless connection system 150 may include circuitry, operating instructions and/or a combination thereof of a conventional wireless communication system. In some embodiments, the wireless connection system 150 may be included within the nonvolatile main memory 130 or within another memory of the USB device 100. One skilled in the art will understand the operation and configuration of the wireless connection system 150. A portion of the wireless connection system 150 may be included within the host device wherein the bus 103 and the USB plug 120 provide a connection therebetween.

The wireless connection system 150 is configured as an ultra-wideband (UWB) compliant system. In other embodiments, the wireless connection system 150 may transmit and receive data according to an IEEE 802.11 standard. Of course, the wireless connection system 150 may operate according to other communication standards such as, IEEE 802.16. The wireless connection system 150 may also be configured to operate according to multiple standards. Accordingly, in some embodiments a user may select a desired wireless communication standard via a user interface of the host device (e.g., a keypad, a menu, an audio interface via voice commands, etc.).

An attached protective cover 160 is novel to the invention and therefore is not found in conventional USB devices. The attached protective cover 160 includes a cap 164 and a link 166. The cap 164 may be shaped as an ordinary cap of a conventional USB device to provide protection for the USB plug 120. In some embodiments, the cap 164 may be shaped as a cylinder. As such, the cap 164 may have a cylindrical shape and a rectangular cavity or opening to accommodate the USB plug 120. With a cylindrical shape, the cap 164 could better accommodate a helical antenna on an exterior surface such as a quadrifilar or folded quadrifilar antenna. The height and radius of a cylindrical shaped cap could be dictated at least to some extent by which standard information is being transmitted/received.

The cap 164 is removably couplable from the USB plug 120 and covers the USB plug 120 to protect it from physical and static damage. The cap 164 is constructed to securely fit over the USB plug 120 as a conventional cap for a USB device. Thus, when the USB device 100 is not connected to the host device, (i.e., not in use), the cap 164 can be placed over the USB plug 120 for protection thereof. As such, the cap 164 has multiple surfaces and an opening to fit over the USB plug 120. An attached protective cover is discussed in more detail below with respect to FIG. 2.

Unlike conventional caps of USB devices, an antenna 170 is fabricated, such as by printing or any other known technique, on one surface of the cap 164. In one embodiment, the antenna 170 is a spiral antenna. In some embodiments, the antenna is fabricated on at least two of the surfaces of the cap 164. The antenna 170 is employed by the wireless connection system 150 to wirelessly communicate information as a UWB compliant system. In some embodiments, the wireless connection system and the antenna cooperate to transmit information according to other standards, such as one of IEEE 802.11 or 802.16 standards.

The link 166 is a connecting structure that couples the cap 164 to the body 105. The link 166 is configured to provide a physical and electrical connection between the cap 164 and the body 105. More specifically, the link 166 is configured to provide an electrical connection between the antenna 170 and the wireless connection system 150. In FIG. 1, the electrical connection provided by the link 166 is a feedline for the antenna 170. As such, unlike conventional USB devices that provide wireless communication, the wireless connection system 150 employs the antenna 170 fabricated on a surface of the cap 164 and uses the link 166 as a feedline to the antenna 170. In other embodiments, the electrical connection of the link 166 may be radiating element. As such, at least a portion of the antenna 170 may be configured as a capacitive hat for radiating element.

The link 166 is constructed of a high tensile material that allows the cap 164 to be positioned away from the body 105 when removed from covering the USB plug 120. As such, the link 166 provides a separation, an air interface, between the cap 164 and the body 105. The air interface between the cap 164 and the body 105 reduces the interference due to the circuitry within the body 105 and the dielectric housing encasing the circuitry. The link 166 may include a circuit trace or a microstrip to provide the electrical connection between the cap 164 and the wireless connection system 150.

In one embodiment, the link 166 may be constructed of Kapton® material manufactured by DuPont™. With a Kapton® link, a transmission line can be fabricated thereon. In other embodiments, the link 166 may be constructed of another material providing similar electrical and mechanical properties. For example, coaxial cables with stiff outer sheaths can also provide a structure with memory which will return to a fixed position after removal of the cap 164 from the USB plug 120. Composite laminated structures (e.g., similar to strips that are used for nasal passage control such as Breathe Right® products by CNS, Inc.,) may also be used to provide the necessary tensile characteristics needed to position the antenna 170 in a desired manner. The above examples are not all inclusive and variants or combinations of the examples are possible.

Unlike a body of a conventional USB device, the body 105 includes a receptacle 160 that is configured to connect the link 166 to the body 105 at the second end 115. Of course one skilled in the art will understand that the link may be attached to the body 105 at another location or by another means. The receptacle 160 is coupled to the bus 103 to complete an electrical path from the antenna 170, through the link 166 and to the wireless connection system 150.

The receptacle 160 allows the link 166 to be electrically and mechanically coupled to the body 105 and maintains that connection when the cap 164 is removed from the USB plug 120 and positioned away from the body 105. In one embodiment, the receptacle 160 may be a conventional surface mount coaxial connector. For example, the receptacle 160 may be a SubMiniature version B (SMB) connector or a SubMiniature version C (SMC) connector. In other embodiments, including when the link 166 is constructed of Kapton®, the receptacle 160 may be a zero insertion force (ZIF) wire-to-board connector. Other connectors may also be used that allow the link 166 to be electrically and mechanically coupled to the body 105 and maintain that connection when the cap 164 is removed from the USB plug 120 and positioned away from the body 105.

Figure 2:
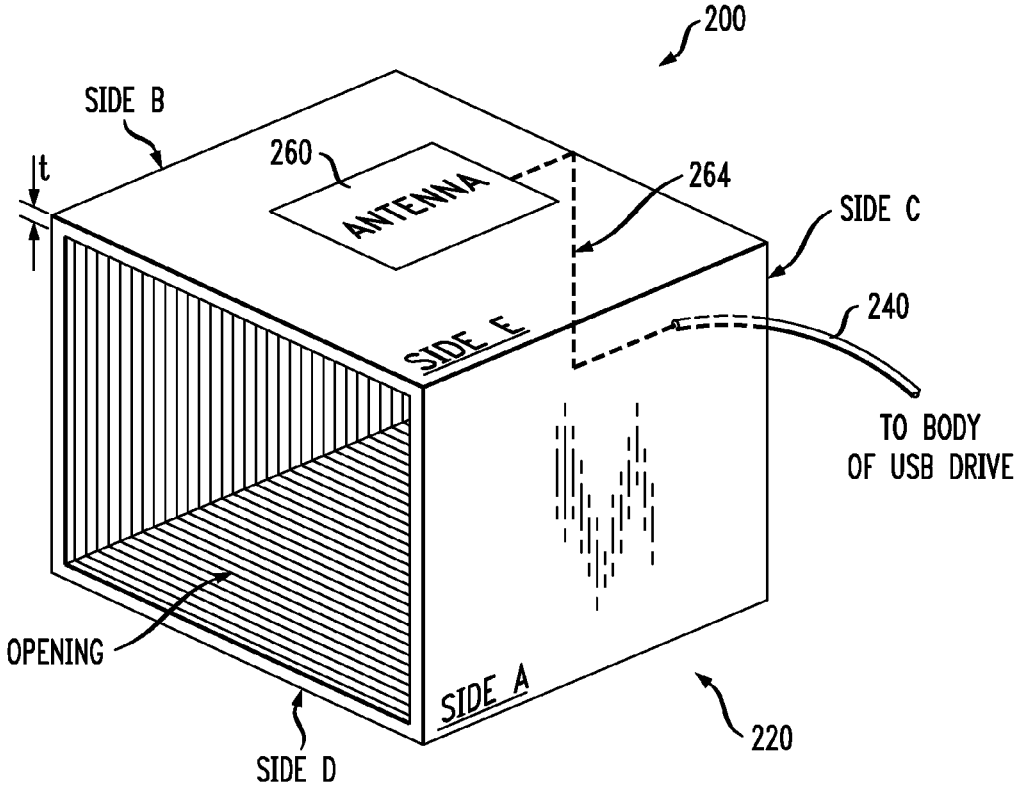
FIG. 2 illustrates an embodiment of a block diagram of an attached protective cover of a USB device constructed according to the principles of the present invention.

Turning now to FIG. 2, illustrated is an embodiment of a block diagram of an attached protective cover of a USB device, generally designated 200, constructed according to the principles of the present invention. The attached protective cover 200 includes a cap 220 and a link 240. Integral to the cap 220 is an antenna 260.

The cap 220 is constructed of a dielectric material and formed to securely fit over a USB plug to provide mechanical and static protection to the USB plug during storage (i.e., not in use). The cap 220 has the general look and size of a conventional USB device cap. As noted above with respect to FIG. 1, the cap 220 may have a cylinder shape. The cap 220 has multiple sides, designated side A, B, C, D and E, which form an opening that encompasses the USB plug for protection. Each of the designated sides has a thickness, represented by t with respect to side E, such that each side has an outer surface and an inner surface.

The antenna 260 may be a variety of antennas and, as such, is represented by the appropriately labeled box. As discussed further below, the antenna 260 may a portion of an antenna such as a capacitive hat for a radiating element. In FIG. 2, the antenna 260 is fabricated on the outer surface of side E and connected to the link 240 via a conductive path 264 integral with the cap 220. The conductive path 264 may be a circuit trace or a microstrip. In some embodiments, the conductive path 264 may be integrally connected to the link 240. Additionally, the conductive path 264 and the link 240 may be connected via a solder connection. In some embodiments, the conductive path 264 may be coupled to the link 240 via a receptacle (not shown). This receptacle may be, for example, an SMB or SMC connector. Alternatively, the receptacle at the cap 220 may be configured as some type of ZIF wire-to-board connector.

In one embodiment the antenna 260 is a spiral tap antenna. Of course the antenna 260 may be any other antenna that can be fabricated on the multiple surfaces of the cap 220. For example, the antenna 260 may be a helical antenna such as a quadrifilar or folded quadrifilar antenna. Additionally, the antenna 260 may include multiple portions that are fabricated on multiple surfaces of the cap 220. For example, a first portion of the antenna 260 may be fabricated on the outer surface of side E and a second portion of the antenna 260 may be fabricated on the outer surface of side D. In some embodiments, a first and second portion of the antenna 260 may be fabricated on the outer surface and the inner surface of a single side.

The antenna 260 may include multiple antennas. For example, the antenna 260 may include a monopole antenna and a dipole antenna. In one embodiment, the monopole antenna may be fabricated on one surface of the cap 220 while the dipole antenna is fabricated on another surface of the cap 220. U.S. Pat. No. 7,057,560 to Erkocevic, et al., which is incorporated herein by reference in its entirety, includes examples of the various antennas that may be integrated with the cap 220.

The antenna 260 may include multiple portions of an antenna, such as an antenna trace and a ground plane. The antenna 260 may also include an insulation region extending through the cap 220 and located between the various portions as presented in U.S. Pat. No. 6,759,984 to Wielsma, which is incorporated in Erkocevic and is also incorporated by reference in the present invention in its entirety. For example, the antenna 260 may include the insulation region located between the antenna trace and the ground plane. The insulation region can include a plurality of insulation regions and, in some embodiments, the insulation regions can be separated by a portion of the cap 220. The insulation region can be air or include an insulation material such as, Acrylonitrile Butadiene Styrene (ABS) plastic, ceramic or Teflon.

In some embodiments, a portion of the antenna 260 may be within a side of the cap 220. In other words, the antenna 260, or at least part of the antenna 260, can be buried in the cap 220. Thus, an antenna integral with the cap 220 may include portions fabricated on a surface of the cap 220 and/or portions included between the surfaces of a side of the cap 220. One skilled in the art will understand the various options of integrating the antenna 260 with the cap 220.

The link 240 is a connecting structure that couples the cap 220 to a body of a USB device (not illustrated in FIG. 2). The link 240 is configured to provide a physical and electrical connection between the cap 220 and the body. The electrical connection provided by the link 240 creates a path between the antenna 260 and a wireless connection system of the USB device to enable data to be transmitted and received wirelessly through the antenna 260. As such, the link 240 is a feedline for the antenna 260. The link 240 may include a circuit trace or a microstrip to provide the electrical connection between the cap 220 and the wireless connection system.

In some embodiments, the link 240 may be a radiating element and the antenna 260 or at least a portion thereof is a capacitive hat located at the end of the link 240. In this embodiment, the antenna 260, the capacitive hat, modifies the electrical characteristics of the link 240, the radiating element, by electrically lengthening the radiating element to optimize it for a given frequency band. One skilled in the art will understand the use of a capacitive hat to modify the electrical characteristics of a radiating element.

The link 240 is constructed such that the cap 220 can be positioned away from the body when removed from covering the USB plug and still be attached to the body. Thus, the link 240 can provide a separation, an air interface, between the antenna 260 and the body. The air interface between the cap 220 and the body reduces interference due to the circuitry within the body 105 and the dielectric housing encasing the circuitry when the antenna 260 is wirelessly communicating. The link 240 may be connected to the body via a receptacle as discussed with respect to FIG. 1.

Figure 3:
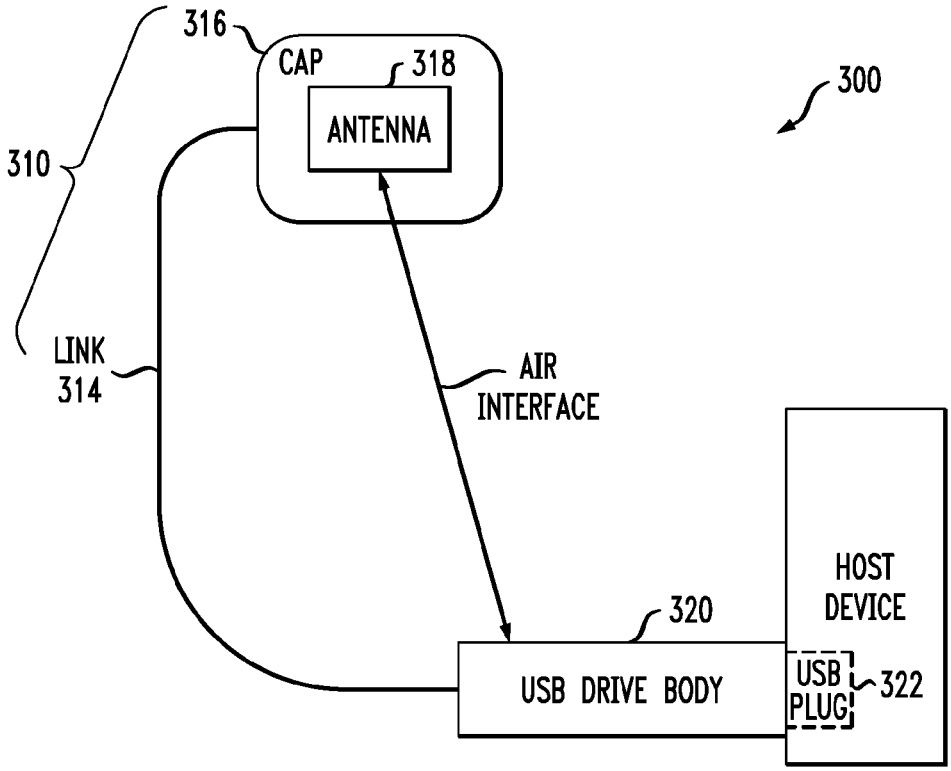
FIG. 3 illustrates an embodiment of an overview diagram of a USB device with an attached protective cover constructed according to the principles of the present invention.

Turning now to FIG. 3, illustrated is an embodiment of an overview diagram of a USB device 300 constructed according to the principles of the present invention. The USB device 300 is connected to a host device and includes an attached protective cover 310 and a body 320 having a USB plug 322. The attached protective cover 310 includes a link 314 and a cap 316 having an antenna 318. As illustrated, the cap 316 is removed from protecting the USB plug 322 such that the USB device 300 is connected to the host device via the USB plug 322. The USB device 300, therefore, can provide wireless connectivity for the host device.

The link 314 insures that the cap 316 remains attached to the body 320 even when removed from the USB plug 322. The link 314 also provides an electrical connection between the cap 316 and the body 320 to provide a feedline between a wireless connection system (not illustrated) associated with the USB device 300 and the antenna 318. In addition, the link 314 is constructed of a high tensile material that allows the cap 316 to be positioned away from the body 320 to create an air interface between the antenna 318 and the body 320. In other words, the link 314 allows the cap 316 to be positioned away from the body 320 and maintain that position until re-positioned or placed on the USB plug 322. The air interface created between the cap 316 and the body 320 due to the positioning of the cap 316 reduces interference to the antenna 318 from the body 320 when wirelessly communicating data.

In FIG. 3, the link 314 is a tether constructed of a material such as Kapton®. In other embodiments, the link 314 may be constructed of another material or configured in another way as long as an electrical and physical connection is maintained between the cap 316 and the body 320 even when the cap 316 is removed from covering the USB plug 322. For example, in an alternative embodiment, the link 314 may be constructed of a low tensile material such that the cap 316 hangs from the body 320 when removed from the USB plug 322. Thus, even though the cap 316 cannot be positioned and maintained in this alternative embodiment, an air interface is still created between the antenna 318 and the body 320. In other embodiments, the link 316 may be a rigid arm that pivots from the body to allow the cap 316 to be removed from the USB plug 322 and still remain connected to the body 320. A pivot-arm structure that couples a cap to a USB body is well known in the art.

Figure 4:
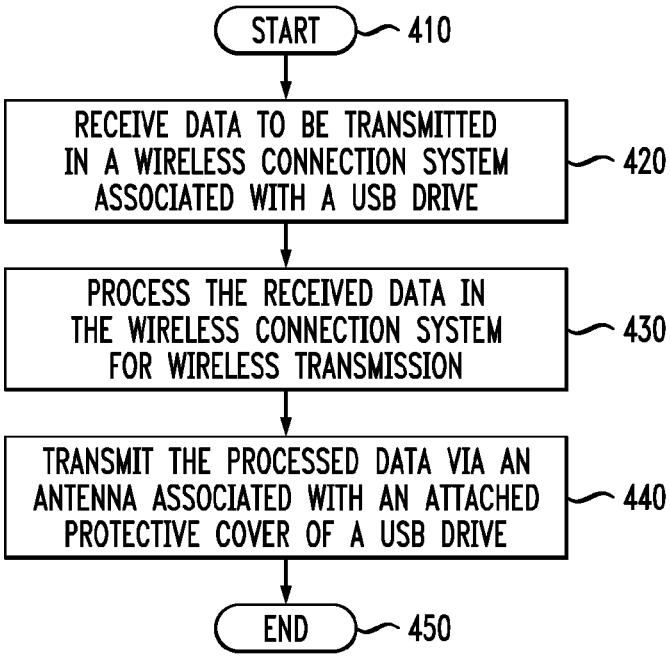
FIG. 4 illustrates a flow diagram of an embodiment of a method for wirelessly transmitting data carried out according to the principles of the present invention.

Turning now to FIG. 4, illustrated is a flow diagram of an embodiment of a method for wirelessly transmitting data, generally designated 400, carried out according to the principles of the present invention. The method to wirelessly transmit data begins in a start step 410.

In a step 420, data to be transmitted is received in a wireless connection system associated with a USB device connected to another device. In one embodiment, at least a portion of the wireless connection system is contained within the USB device. A portion of the wireless connection system may also be within a host device.

After receiving the data, the data is processed for wireless transmission by the wireless connection system in a step 430. Processing the data for wireless transmission includes converting the data from a hardwired protocol to a wireless protocol. One skilled in the art will understand the configuration and operations needed to process data for wireless transmission.

After processing, the processed data is transmitted via an antenna associated with an attached protective cover of a USB device in a step 440. The attached protective cover may include a cap and a link. The antenna, or at least a portion of the antenna, may be fabricated on one or multiple surfaces of the cap. In one embodiment, the antenna is a spiral antenna.

Additionally, a portion of the antenna may be included within a side of the cap (i.e., buried between an outer and an inner surface of the side).

The link may be a feedline for the antenna and provide a conduit for the data between the wireless connection system and the antenna. Alternatively, the link may be a radiating element for the antenna. The data may be wirelessly transmitted in compliance with a standard such as, IEEE 802.11 or 802.16 standards. Additionally, the data may be wirelessly transmitted employing an UWB technology. Of course, the data may be transmitted according to other wireless communicating standards.

The method 400 of wirelessly transmitting data ends in a step 450. One skilled in the art will appreciate that the above antenna may also be used to wirelessly receive data. As such, the wireless connection system would receive the wirelessly transmitted data and convert it to a hardwire protocol for the host device.

Although the present invention has been described in detail, those skilled in the pertinent art should understand that they can make various changes, substitutions and alterations herein without departing from the spirit and scope of the invention in its broadest form. For example, instead of a USB device, another solid state memory device may be used. A solid state memory device is a memory device with no moving parts. Thus, a device that is not compatible with a USB plug does not depart from the scope of the present invention. As such, an attached protective cover of the present invention would have a cap including an antenna associated therewith and configured to protect a connector of the solid state memory device and a link configured to provide a physical connection between the cap and a body of the solid state memory device and an electrical connection between the antenna and a wireless connection system included within the body.

What is claimed is:

1. An attached protective cover of a USB device having a body, comprising:

a cap including an antenna associated therewith and configured to protect a USB plug of said USB device; and a link configured to provide a physical connection between said cap and said body and an electrical connection between said antenna and a wireless connection system included within said body, wherein said link is a radiating element of said antenna.

2. The attached protective cover as recited in claim 1 wherein said antenna is a spiral antenna.

3. The attached protective cover as recited in claim 1 wherein said cap has multiple surfaces and at least a portion of said antenna is fabricated on at least one of said multiple surfaces.

4. The attached protective cover as recited in claim 1 wherein said antenna employs an ultra-wideband technology for wirelessly communicating data.

5. The attached protective cover as recited in claim 1 wherein said antenna transmits information according to a standard selected from the group consisting of:

IEEE 802.11, and

IEEE 802.16.

6. The attached protective cover as recited in claim 1 wherein said link is constructed of a tensile material to allow said cap to be positioned away from said body when removed from said USB plug.

7. The attached protective cover as recited in claim 1 wherein said link includes a circuit trace configured to provide said electrical connection between said antenna and said wireless connection system.

8. The attached protective cover as recited in claim 1 wherein said link includes a microstrip configured to provide said electrical connection between said antenna and said wireless connection system.

9. The attached protective cover as recited in claim 1 wherein said link is configured to provide an air interface between said antenna and said body when said USB plug is in use.

10. The attached protective cover as recited in claim 1 wherein said antenna has multiple portions and said cap includes an insulation region extending there through and located between said portions.

11. The attached protective cover as recited in claim 1 wherein at least a portion of said antenna is fabricated on said cap and is a capacitive hat configured to electrically modify said radiating element.

12. A USB device, comprising:

a body having a memory including a wireless connection system;

a USB port coupled to said memory and including a USB plug; and an attached protective cover removably couplable from said USB plug, said attached protective cover including:

a cap having an antenna integrated therewith and configured to protect said USB plug; and a link configured to provide a physical connection between said cap and said body and an electrical connection between said antenna and said wireless connection system, wherein said link is a radiating element of said antenna and is configured to provide an air interface between said cap and said body when said cap is removed from covering said USB plug.

13. The USB device as recited in claim 12 wherein said antenna is fabricated on said cap.

14. The USB device as recited in claim 12 wherein said antenna is a spiral antenna.

15. The USB device as recited in claim 12 wherein said cap has multiple surfaces and said antenna is fabricated on at least one of said multiple surfaces.

16. The USB device as recited in claim 12 wherein said wireless connection system and said antenna are configured to transmit and receive information employing an ultra-wideband technology.

17. The USB device as recited in claim 12 wherein said wireless connection system and said antenna cooperate to transmit information according to a standard selected from the group consisting of:

IEEE 802.11, and

IEEE 802.16.

18. The USB device as recited in claim 12 wherein said link includes a circuit trace or a microstrip configured to provide said electrical connection between said antenna and said wireless connection system.

19. The USB device as recited in claim 12 wherein said memory is selected from the group consisting of:

a magnetic hard disk drive, a non-volatile main memory, a flash memory.

20. A method of wirelessly transmitting data, comprising:

receiving data to be transmitted in a wireless connection system associated with a USB device connected to another device;

processing said data for wireless transmission employing said wireless connection system; and transmitting said processed data via an antenna integrated with an attached protective cover of said USB device, said attached protective cover including a link and a cap, wherein said link is a radiating element of said antenna.

21. The method as recited in claim 20 wherein at least a portion of said wireless connection system is within said USB device.

22. The method as recited in claim 20 wherein said antenna is fabricated on at least one of the multiple surfaces of a cap of said attached protective cover.

23. The method as recited in claim 20 wherein at least a portion of said antenna is fabricated on a surface of said attached protective cover.

24. The method as recited in claim 20 wherein said antenna is a spiral antenna fabricated on a surface of a cap of said attached protective cover.

25. The method as recited in claim 20 wherein said transmitting includes transmitting said processed data according to one of the following IEEE standards selected from the group consisting of:

IEEE 802.11 standard, and

IEEE 802.16 standard.

26. The method as recited in claim 20 wherein said transmitting employs an ultra-wideband technology.

27. The method as recited in claim 20 wherein said cap includes a capacitive hat of said antenna.

28. An attached protective cover of a USB device having a body, comprising:

a cap including an antenna associated therewith and configured to protect a USB plug of said USB device, wherein said antenna has multiple portions and said cap includes an insulation region extending there through and located between said portions; and a link configured to provide a physical connection between said cap and said body and an electrical connection between said antenna and a wireless connection system included within said body.

* * * * *